US006227736B1

(12) United States Patent
Sogaro

(10) Patent No.: US 6,227,736 B1
(45) Date of Patent: May 8, 2001

(54) MULTI-CHAMBER AMPOULE FOR MEASURED DOSES OF LIQUIDS

(75) Inventor: Alberto Sogaro, Kronberg (DE)

(73) Assignee: Dentaco Dentalindustrie-und Marketing GmbH, Bad Homburg (DE)

( * ) Notice: Subject to any disclaimer, the term of this patent is extended or adjusted under 35 U.S.C. 154(b) by 0 days.

(21) Appl. No.: 09/171,446

(22) PCT Filed: Feb. 14, 1998

(86) PCT No.: PCT/DE98/00430

§ 371 Date: Aug. 19, 1999

§ 102(e) Date: Aug. 19, 1999

(87) PCT Pub. No.: WO98/36994

PCT Pub. Date: Aug. 27, 1998

(30) Foreign Application Priority Data

Feb. 20, 1997 (DE) ..... 197 06 932

(51) Int. Cl.[7] ..... A46B 11/00
(52) U.S. Cl. ..... 401/123; 401/125; 401/118
(58) Field of Search ..... 401/123, 118, 401/119, 124, 125, 126, 127, 129

(56) References Cited

U.S. PATENT DOCUMENTS 4,793,476 12/1988 Schrupp ..... 206/222
5,492,426 * 2/1996 Geuret ..... 401/126
6,082,918 * 7/2000 Gueret ..... 401/126

FOREIGN PATENT DOCUMENTS 92 02 654 U 6/1992 (DE) .
0 295 265 B1 3/1987 (EP) .
0 332 487 A1 2/1989 (EP) .
0 577 200 A1 6/1993 (EP) .
0 688 516 A1 5/1995 (EP) .
2182522 12/1973 (FR) .

OTHER PUBLICATIONS

PCT Search Report from Appln. No. PCT/DE98/00430, dated Aug. 4, 1998.
Patent Abstracts of Japan, Publ. No. 08187121, Publ. date Jul. 23, 1996, "Applicator for Liquid Material Having Adhesion," Inventor Yaita Shigeru.

* cited by examiner

*Primary Examiner*—David J. Walczak
(74) *Attorney, Agent, or Firm*—Quarles & Brady, LLP

(57) ABSTRACT

A multi-chamber ampoule for measured doses of liquids, which has an outer sleeve (2) of elastic material which on the inside has a first chamber (12) which extends along an axis (y) and is closed off by a first bottom (31) at the lower end. A closing element seals the outer sleeve (2) at its head end and has a micro brush (1) which at its tip (10) has a flocculus (11) capable of absorbing a liquid. The micro brush (1) is positioned in an inner sleeve (3) which can be moved inside the outer sleeve (2) in the manner of a plunger.

21 Claims, 2 Drawing Sheets

MULTI-CHAMBER AMPOULE FOR MEASURED DOSES OF LIQUIDS

The invention relates to a multi-chamber ampoule for measured doses of liquids comprising an outer sleeve of elastic material which on the inside has a chamber which extends along an axis and is closed off by a bottom part at the lower end and a closing element which seals the outer sleeve at its head end, and a which has a micro brush which at its tip has an element capable of absorbing a liquid.

A multi-chamber ampoule of this type has been known from DE -G 92 02 654. In the case of the prior art ampoule, the chamber cavity is divided by the liquid filled in itself into two chambers. In the lower chamber, there is the measured dose and above the liquid, there is air.

There are, however, particular liquids which have to be filled in substantially under the exclusion of air. The disadvantage of the prior art ampoule is that because of the micro brush which extends into the chamber cavity, too much of the liquid has to be filled in in order to substantially drive out the air. A further disadvantage is that in case of excessive filling, either the shaft or the head portion of the micro brush are also wetted which, during draining or discharging, may lead to undesired dripping-off actions.

It is therefore the object of the present invention to provide a multi-chamber ampoule wherein in spite of the micro brush being present, the liquid may be filled in a measured dose substantially under the exclusion of air.

The object of the invention is solved by the features of claim 1.

In accordance with the invention, there is provided a multi-chamber ampoule wherein the micro brush is housed separately from the measured dose of the liquid within a lower chamber of an outer sleeve. The micro brush is supported in a hollow and piston-like inner sleeve which forms a movable closing element for the outer sleeve with the lower chamber. The lower sleeve is encased as a piston slidable within the outer sleeve. The inner sleeve forms a second and upper chamber into which extends the micro brush with its tip.

It is essential that the wall of the inner sleeve includes radial bores which are sealed by the wall of the outer sleeve. By sliding in the micro brush, the piston-like inner sleeve is pressed into the liquid under it. Thereby, the outer elastic wall of the outer sleeve expands, or the wall of the inner sleeve is pressed towards the interior, respectively. In this way, a small wall gap between the walls is produced through which the liquid can flow through the bores into the chamber which contains the micro brush.

By completely lowering the inner sleeve, the total liquid flows from the first chamber of the outer sleeve into the second chamber of the inner sleeve. The expansion of the wall gap between the inner and the outer sleeve is amplified by a sealing lip in the lower area of the inner sleeve when the sealing lip has been moved out of the corresponding sealing groove.

Based on the invention, the liquid to be dosed may be stored under minimum air inclusion and separate from the micro brush. The micro brush itself constitutes the tool for lowering the inner sleeve.

The invention permits even the storing of a two-component liquid. One component is provided in the lower chamber of the outer sleeve which is closed by the inner sleeve. The other component is stored in the second chamber which includes the inner sleeve and which contains the micro brush.

In the following, the invention is explained in more detail based on the drawing, wherein FIG. 1 shows a longitudinal cross section through one embodiment of the invention;

Figure 1:
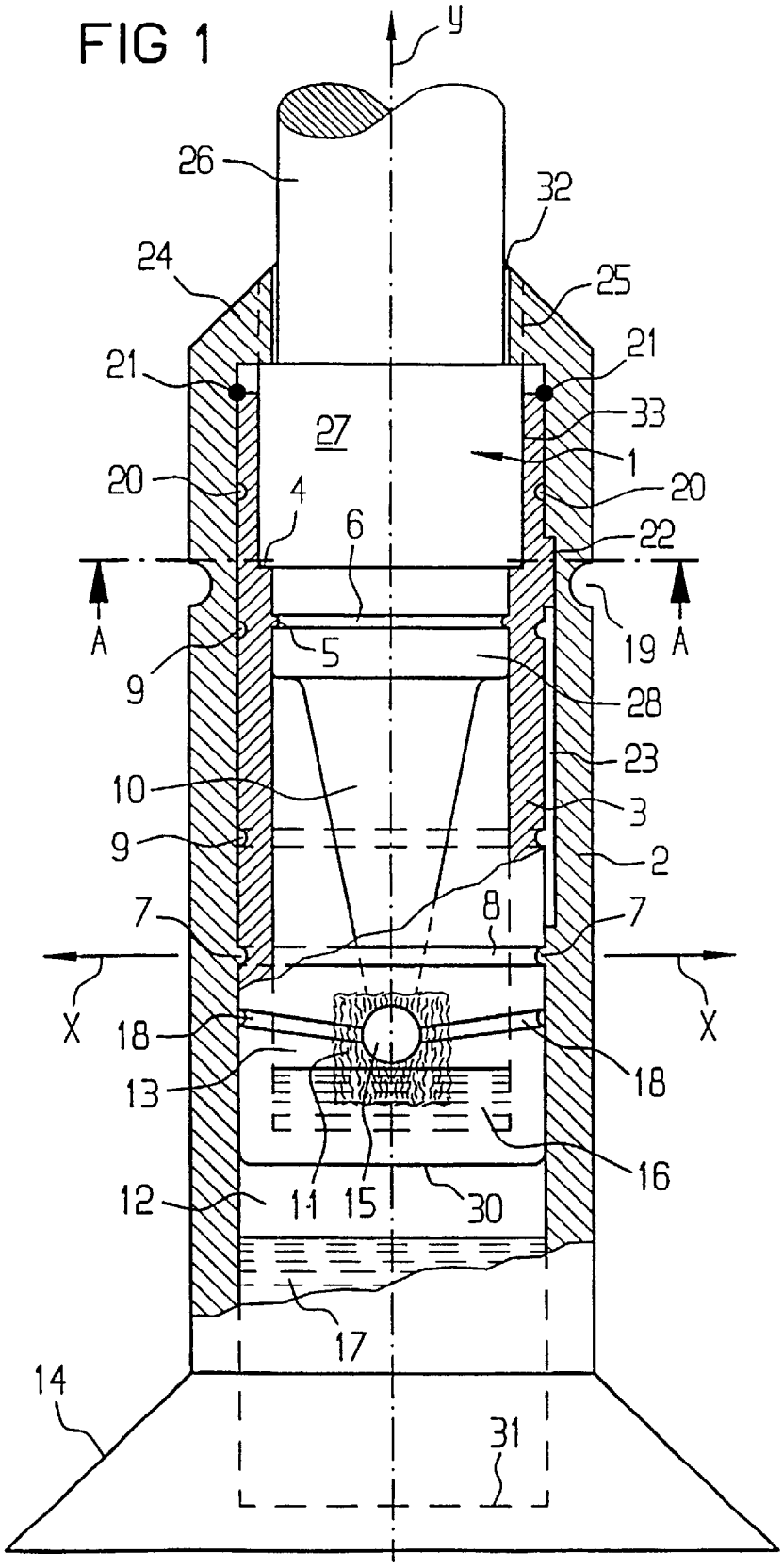

FIG. 1 shows a longitudinal cross section through a multi-chamber ampoule which comprises an outer sleeve 2. Outer sleeve 2 has a base 14 and a cylindrical cavity forming a first chamber 12. In first chamber 12, a second liquid 17 is provided. First chamber 12 has preferably has a planar from bottom. Outer sleeve 2 extends along the axis y (longitudinal axis of the ampoule) and is open on the top.

Within outer sleeve 2 which has an essentially smooth inner wall a piston-like inner sleeve 3 is encased. Inner sleeve 3 is encased movably along axis y within outer sleeve 2. Second bottom 30 of inner sleeve 3 forms a closing means for second liquid 17 stored in first chamber 12. Since the outer wall of inner sleeve 3 rests liquid-tight against the inner wall of outer sleeve 2, inner sleeve 3 forms a closing element for first chamber 12 of the outer sleeve 2.

Inner sleeve 3 is open on the top as is outer sleeve 2; however, a micro brush 1 with its head portion 28 and its shaft 27 is provided in sealed arrangement within inner sleeve 3 sealing the first opening 33 of inner sleeve 3. Micro brush 1 has a rod-shaped handle 26 extending from second opening 32 of outer sleeve 2. By forming a back taper 24, outer sleeve 2 lies sealingly against handle 26. It is, however, possible to provide a correspondingly wide third opening 25 in order to be able to withdraw micro brush 1 from outer sleeve 2.

Between the inner wall of inner sleeve 3 and micro brush 1, a sealing means is provided consisting, in FIG. 1, of an upper sealing lip 5 and an upper sealing groove 6 which encircles head portion 28 as an annular groove. If required, further sealing means may be provided.

In the same way, a sealing means is provided between the inner wall of outer sleeve 2 and the outer wall of inner sleeve 3. In FIG. 1, this sealing means consists of a lower sealing lip 7 and a lower sealing groove 8 which effect simultaneously that inner sleeve 3 is maintained at an upper height position. According to FIG. 1, there are provided, in parallel to the lower sealing groove 8, higher-arranged grooves which form latching elements in the form of latching grooves 9. By means of latching grooves 9, the piston-like inner sleeve 3 may step-wisely be lowered.

First bottom 31 of outer sleeve 2 is adapted to the shape of second bottom 30 of inner sleeve 3 so that in the completely lowered position of inner sleeve 3 no gap will be left. First bottom 31 and second bottom 30 are preferably planar but may for instance also be spherically curved. If and when second bottom 30 rests on first bottom 31, the uppermost latching groove 9 engages with lower sealing lip 7. That means that the height of lift of second bottom 30 corresponds to the distance of lower sealing groove 8 to uppermost latching groove 9.

Holding forces between outer sleeve 2 and inner sleeve 3 are greater than the holding forces of micro brush 1 within inner sleeve 3 is. Thereby, it is safeguarded that when micro brush 1 is withdrawn, the inner sleeve is not drawn upwards.

Inner sleeve 3 defines a second chamber 13 which may be filled with a first liquid 16. In this way, two chambers are formed which accommodate a two-component solution. The first chamber 12 may essentially be filled up, however, with a small residual air portion. In order to remove the residual air, the inner sleeve 3 may be lowered to a corresponding position prior to being closed by micro brush 1. Likewise, it is possible to fill the ampoule standing on its head and, after having filled the ampoule, attaching base 14 by welding.

At head portion 28 of micro brush 1, a tip 10 is formed which, according to FIG. 1, is covered with flocculus 11. Tip 10 extends essentially to the bottom area of second chamber 13. Instead of a flocculus 11, brush hair can be provided. Tip 10 may also be pressed directly against the bottom of second chamber 13 if inner sleeve 3 is to be lowered. On micro brush 1, however, there is preferably provided a bearing shoulder 4 which rests for instance on a step in the wall of inner sleeve 3. Thus the inner sleeve 3 may also be lowered with a micro brush 1 having brush hair.

It is now essential for the lowering process of inner sleeve 3 that means be provided permitting an overflowing of second liquid 17 from first chamber 12 into second chamber 13 of inner sleeve 3. To this end, the wall of inner sleeve 3 has radial bores 15 arranged in a portion near the bottom of inner sleeve 3. Depending on the viscosity of second liquid 17, one or a plurality of bores 15 may be provided. The bores 15, of which in FIG. 1 only one is visible, are directed towards the inner wall of outer sleeve 2. Consequently, the inner wall of outer sleeve 2 seals the bores 15 in the wall of inner sleeve 3.

During the course of the downward movement of inner sleeve 3, second liquid 17 squeezes between the outer wall of inner sleeve 3 and the inner wall of outer sleeve 2 towards bore 15 and thus can flow over into second chamber 13. To make it possible for the walls of inner sleeve 3 and outer sleeve 2 to separate from one another, the ampoule is made of spring-elastic material.

It is, furthermore, essential that the formation of a wall gap between inner sleeve 3 and outer sleeve 2 is amplified by the sealing means, consisting of annular lower sealing lip 7 and lower sealing groove 8. To this end, it is important that lower sealing lip 7 is located above first chamber 12, or the liquid level of second liquid 17, respectively. By the downward movement of inner sleeve 3, lower sealing lip 7 moves out of the lower sealing groove 8. Lower sealing lip 7 starts gliding on the outer wall of inner sleeve 3. With a view to the now smaller diameter, inner sleeve 3 presses the wall of outer sleeve 2 into the direction of arrows x towards the outside, or the wall of inner sleeve 3 is pressed towards the inside, respectively. Functionally, the sealing means consisting of lower sealing lip 7 and lower sealing groove 8 serves additionally to increase, during the downward movement of inner sleeve 3, the wall gap to make it easy for second liquid 17 to flow over. It does not matter in this connection whether lower sealing lip 7 is formed on outer sleeve 2 or on inner sleeve 3 in order to produce the spreading or expanding effect in the direction of arrows x.

Preferably, at the outer wall of inner sleeve 3, a collecting channel 18 is provided so that the liquid can find more rapidly its way into bores 15 and high pressure will not be established during the course of the flowing process of second liquid 17 between the walls. In this way, the bursting of outer sleeve 2 is avoided.

Preferably, collecting channel 18 connecting bores 15 surrounds the outer wall of inner sleeve 3 in a wave-like curve path so that bores 15 are located in the wave troughs. Since the individual sections of collecting channel 18 form inclined planes, it is safeguarded that all remaining portions of second liquid 17 flow off into second chamber 13 and no residual portions will remain in collecting channel 18. In cooperation with the additional latching grooves 9 arranged at predetermined height positions, portions of second liquid 17 may dosedly be brought over into second chamber 13. That is, the volume of first chamber 12 may stepwisely be reduced. At the same time, the remainder of second liquid 17 in first chamber 12 remains furtheron well-sealed therein.

FIG. 1 shows, furtheron, a welding 21 in the upper portion of inner sleeve 3 and outer sleeve 2. It shows likewise a surrounding first rated breaking point 19 on outer sleeve 2 and a surrounding second rated breaking point 20 on inner sleeve 3. A guide channel 23 is, furtheron, provided in outer sleeve 2 and a nose 22 on the outer wall of inner sleeve 3. Guide channel 23 has an L-shape wherein an annular section encircles axis y and a straight-lined section extends in parallel relative to axis y. In FIG. 1, it is only the straight-lined section which is essentially visible. Nose 22 is matched to guide channel 23.

Figure 2:
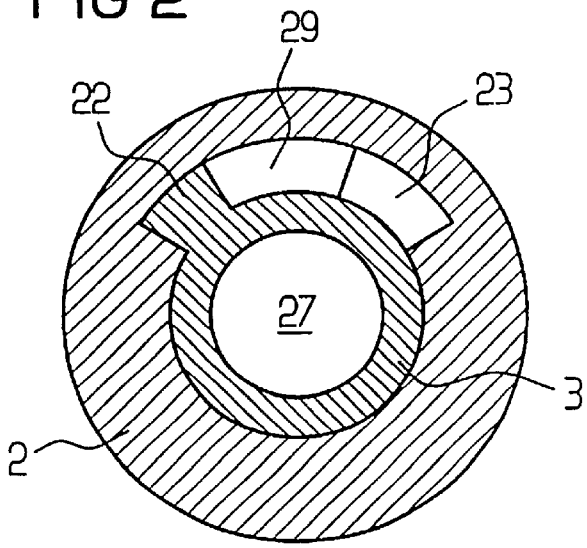
FIG. 2 shows a sectional view along line AA of FIG. 1.

FIG. 2 shows a sectional view through the area of guide channel 23 and the cylindrical walls of outer sleeve 2 and inner sleeve 3 concentrically arranged around shaft 27. First rated breaking point 19 and second rated breaking point 20 as well as nose 22 and guide channel 23 constitute a childproof safety scheme. In the position shown in FIG. 2, nose 22 rests on the annular section of the L-shape of guide channel 23. The annular section forms at the same time a sliding surface 29 for nose 22. Lowering of inner sleeve 3 in the position shown is not possible.

For lowering, outer sleeve 2 of FIG. 2 should be maintained below first rated breaking point 19 and rotated clockwise above first rated breaking point 19. When this is done, first rated breaking point 19 will tear and nose 22 is slidingly guided on sliding surface 29 to the straight-lined section of guide channel 23. Subsequently, a downward force is placed on inner sleeve 3 and nose 22 slides within the straight-lined section of guide channel 23. When this is done, the second rated breaking point 20 tears and the inner sleeve 3 may be moved within the outer sleeve 2 along the axis (y).

Hence, sliding surface 29 and first rated breaking point 19 act together, as a first measure, to prevent a lowering of inner sleeve 3. As a second safety measure, welding 21 and second rated breaking point 20 act together to prevent a lowering of inner sleeve 3 although nose 22 is located above the straight-lined section of guide channel 23. If there is a less dangerous second liquid 17 in first chamber 12, welding 21 and second rated breaking point 20 may for instance be dispensed with. In a further embodiment, it is also possible to arrange guide channel 23 vice versa so that, first, a straight-line shift and, subsequently, a rotating movement are necessary to lower inner sleeve 3.

The upper and separated parts of outer sleeve 2 and inner sleeve 3 are moved by handle 26 in the direction of axis y and constitute a finger protection against back-flowing second liquid, when the soaked micro brush 1 is taken out.

Figure 3:
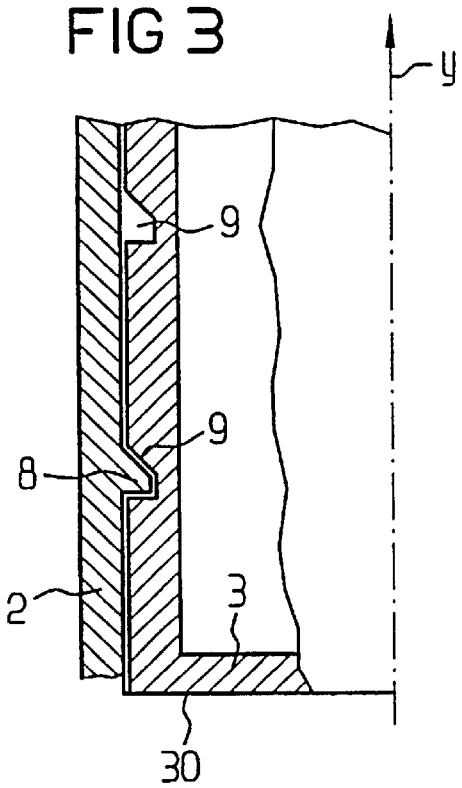
FIG. 3 shows a detailed view of one embodiment of latching elements.

By means of latching grooves 9, step-wise lowering and dose-wise filling of second liquid 17 into second chamber 13 is possible. FIG. 3 shows that the locking elements comprising lower sealing lip 7, lower sealing groove 8, and latching groove 9 may be shaped in form of a blocking elements having as a barrage back tapers so that backward movement of inner sleeve 3 when withdrawing micro brush 1 is completely prevented.

LIST OF REFERENCE NUMERALS

01=Micro Brush
02=Outer Sleeve
03=Inner Sleeve
04=Bearing Shoulder
05=Upper Sealing Lip
06=Upper Sealing Groove
07=Lower Sealing Lip
08=Lower Sealing Groove

09=Latching Groove
10=Tip
11=Flocculus
12=First Chamber
13=Second Chamber
14=Base
15=Bore
16=First Liquid
17=Second Liquid
18=Collecting Channel
19=Rated Breaking Point
20=Second Rated Breaking Point
21=Welding
22=Nose
23=Guide Channel
24=Back Taper
25=Third Opening
26=Handle
27=Shaft
28=Head Portion
29=Sliding Face
30=Second Bottom
31=First Bottom
32=Second Opening
33=First Opening

What is claimed is:

1. Multi-chamber ampoule for measured doses of liquids comprising:

an outer sleeve (2) of elastic material having a first chamber (12) extending along an axis (y), closed at its lower end by a first bottom (31), and a third opening (25) at its upper end;

a closure element closing said outer sleeve (2) at said third opening (25), wherein;

said closure element consists of an inner sleeve (3) comprising a second chamber (13), a second bottom (30) at its lower end, an outer surface, and a first opening (33) at its upper end;

a micro brush (1) has a liquid-absorbing element at its tip (10) and can be inserted and removed from said inner sleeve (3) through said first opening (33);

said micro brush (1) is removably supported in said inner sleeve (3) and a liquid-tight seal is formed between said micro brush (1) and said inner sleeve (3) when said micro brush (1) is inserted into said inner sleeve (3);

said inner sleeve (3) is slidable along axis (y) in said outer sleeve (2) and forms a liquid-tight seal between said inner sleeve (3) and said outer sleeve (2);

said inner sleeve (3) has, in spaced relationship relative to said first bottom (30), radial bores (15) through said inner sleeve (3) providing a passage from said second chamber (13) to said outer sleeve (2);

said second bottom (30) of said inner sleeve (3) is positionable in spaced relationship to said first bottom (31) of said outer sleeve (2);

a plurality of locking elements are provided locking said inner sleeve (3) relative to said first bottom (31) of said outer sleeve (2) at an upper and a lower height position;

said upper height position of said inner sleeve (3) defines a storage position and said lower height position of said inner sleeve (3) defines a discharge position;

said tip (10) of said micro brush (1) is arranged near the bottom of said second chamber (13) of said inner sleeve (3);

an annular lower sealing lip (7) and a corresponding lower sealing groove (8) are disposed between said outer sleeve (2) and said inner sleeve (3); and said lower sealing lip (7) and said lower sealing groove (8) are disposed above said first chamber (12) which is filled with a second liquid (17).

2. Multi-chamber ampoule of claim 1, wherein:

said first chamber (12) of said outer sleeve (2) has a circular cross-section; and said inner sleeve (3) constitutes a circular cylinder.

3. Multi-chamber ampoule of claim 2, wherein said inner sleeve (3) has a diameter of 2.35 mm.

4. Multi-chamber ampoule of claim 1, wherein above said lower sealing lip (7) said lower sealing groove (8) at said upper height position of said inner sleeve (3), a latching groove (9) is provided in said first chamber (12) of said outer sleeve (2).

5. Multi-chamber ampoule of claim 4, wherein said lower sealing lip (7), said lower sealing groove (8) and said latching groove (9) include a back-tapered element which prevents backward movement of said inner sleeve (3) to said upper height position.

6. Multi-chamber ampoule of claim 1, wherein:

said inner sleeve (3) includes an upper sealing lip (5); and said micro brush (1) includes a head portion (28) located above said tip (10) with a corresponding upper sealing groove (6).

7. Multi-chamber ampoule of claim 1, wherein a first holding force produced by the interlocking of said lower sealing lip (7) and said lower sealing groove (8) is greater than a second holding force produced by the interlocking of said upper sealing lip (5) and said upper sealing groove (6).

8. Multi-chamber ampoule of claim 1, wherein:

said micro brush (1) contains a shaft (27) which has a bearing shoulder (4); and said inner sleeve (3) contains a step in which said bearing shoulder (4) rests.

9. Multi-chamber ampoule of claim 1, wherein a welding (21) is provided between said outer sleeve (2) and said inner sleeve (3).

10. Multi-chamber ampoule of claim 1, wherein a plurality of guide elements are provided between said outer sleeve (2) and said inner sleeve (3) which require a rotating movement and a linear movement prior to said inner sleeve (3) being depressed into said outer sleeve (2).

11. Multi-chamber ampoule of claim 10, wherein:

said guide elements consist of a nose (22) attached to said inner sleeve (3) which is movably inserted into a guide channel (23) in said outer sleeve (2); and said guide channel (23) having an L shape formed by first guide section which runs perpendicular to said axis (y) and a second guide section which runs parallel to said axis (y).

12. Multi-chamber ampoule of claim 1, wherein said outer sleeve (2) includes a first rated breaking point (19) and said inner sleeve (3) includes a second rated breaking point (20) in close proximity to said shaft (27) of said micro brush (1).

13. Multi-chamber ampoule of claim 1, wherein said bores (15) are interconnected by a collecting channel (18) which runs annularly around said outer surface of said inner sleeve (3).

14. Multi-chamber ampoule of claim 13, wherein:

said collecting channel (18) forms a wave-shaped curved path; and said bores (15) are located in a plurality of troughs formed by said wave-shaped curved path.

15. Multi-chamber ampoule of claim 1, wherein said tip (10) of said micro brush (1) contains a flocculus (11).

16. Multi-chamber ampoule of claim 1, wherein said outer sleeve (2) has a base (14).

17. Multi-chamber ampoule of claim 1, wherein a first liquid (16) is stored in said first chamber (12) and a second liquid (17) is stored in said second chamber (13).

18. Multi-chamber ampoule of claim 1, wherein a plurality of latch grooves (9) are provided in said inner sleeve (3) such that when said inner sleeve (3) is depressed and moves downward into said outer sleeve (2), a predetermined volume of said second liquid (17) flows from said first chamber (12) to said second chamber (13) as said lower sealing lip (7) engages each latching groove (9).

19. Multi-chamber ampoule of claim 1, wherein said second bottom (30) is flush with said first bottom (31) when said inner sleeve (3) is in said lower height position.

20. Multi-chamber ampoule of claim 19, wherein said second bottom (30) and said first bottom (31) are planar.

21. Multi-chamber ampoule for measured doses of liquids comprising:

an outer sleeve (2) of elastic material having a first chamber (12) extending along an axis (y), closed at its lower end by a first bottom (31), and a third opening (25) at its upper end;

a closure element closing said outer sleeve (2) at said third opening (25), wherein;

said closure element consists of an inner sleeve (3) comprising a second chamber (13), a second bottom (30) at its lower end, an outer surface, and a first opening (33) at its upper end;

a micro brush (1) has a liquid-absorbing element at its tip (10) and can be inserted and removed from said inner sleeve (3) through said first opening (33);

said micro brush (1) is removably supported in said inner sleeve (3) and a liquid-tight seal is formed between said micro brush (1) and said inner sleeve (3) when said micro brush (1) is inserted into said inner sleeve (3);

said inner sleeve (3) is slidable along axis (y) in said outer sleeve (2) and forms a liquid-tight seal between said inner sleeve (3) and said outer sleeve (2);

said inner sleeve (3) has, in spaced relationship relative to said first bottom (30), radial bores (15) through said inner sleeve (3) providing a passage from said second chamber (13) to said outer sleeve (2);

said second bottom (30) of said inner sleeve (3) is positionable in spaced relationship to said first bottom (31) of said outer sleeve (2);

said tip (10) of said micro brush (1) is arranged near the bottom of said second chamber (13) of said inner sleeve (3);

an annular lower sealing lip (7) and a corresponding lower sealing groove (8) are disposed between said outer sleeve (2) and said inner sleeve (3);

said lower sealing lip (7) and said lower sealing groove (8), when engaged, lock said inner sleeve (3) at an upper height position relative to said first bottom (31) of said outer sleeve (2);

said upper height position of said inner sleeve (3) defines a storage position of said inner sleeve (3); and said lower sealing lip (7) and said lower sealing groove (8) are disposed above said first chamber (12) which is filled with a second liquid (17).

* * * * *